US006933668B2

(12) United States Patent
Lee et al.

(10) Patent No.: US 6,933,668 B2
(45) Date of Patent: Aug. 23, 2005

(54) COLOR CATHODE RAY TUBE

(75) Inventors: Jae Wook Lee, Gumi-si (KR); Min Ho Lim, Daegukwangyuk-si (KR)

(73) Assignee: LG. Philips Displays Korea Co., Ltd., Gumi (KR)

( * ) Notice: Subject to any disclaimer, the term of this patent is extended or adjusted under 35 U.S.C. 154(b) by 0 days.

(21) Appl. No.: 10/761,383

(22) Filed: Jan. 22, 2004

(65) Prior Publication Data

US 2004/0217684 A1 Nov. 4, 2004

(30) Foreign Application Priority Data

Jan. 23, 2003 (KR) ..... 10-2003-0004467

(51) Int. Cl.[7] ..... H01J 29/70; H01J 31/00

(52) U.S. Cl. ..... 313/477 R; 220/2.1 R

(58) Field of Search ..... 313/477 R; 220/2.1 A, 220/2.1; 348/744

(56) References Cited

U.S. PATENT DOCUMENTS 6,307,314 B1 * 10/2001 Sano ..... 313/477 R
6,608,454 B2 * 8/2003 Shimizu et al. ..... 313/477 R
6,693,374 B2 * 2/2004 Tho et al. ..... 313/477 R

* cited by examiner

*Primary Examiner*—Joseph Williams
*Assistant Examiner*—Peter Macchiarolo
(74) *Attorney, Agent, or Firm*—Birch, Stewart, Kolasch & Birch, LLP

(57) ABSTRACT

A cathode ray tube according to an embodiment of the present invention includes a panel having an effective screen; a funnel connected to the panel; and an electron gun to generate electron beams. The effective screen has a horizontal and vertical ratio of 16:9; and the panel satisfies a condition: $[(\Delta y/d)\times 100)\leqq 5.65$, wherein d is length from a central point G to a diagonal vertex E of the effective screen, and $\Delta y$ is length from a point H to an intersection point of the outline of the panel and the shorter axis Y, the point H being intersection of shorter axis Y and a longer side of the effective screen.

12 Claims, 3 Drawing Sheets

COLOR CATHODE RAY TUBE

This Non-provisional application claims priority under 35 U.S.C. §119(a) on Patent Application No(s). 10-2003-0004467 filed in Korea on Jan. 23, 2003, the entire contents of which are hereby incorporated by reference.

TECHNICAL FIELD

The present invention relates to a color cathode ray tube and more specifically to a color cathode ray tube having a panel structure which provide characteristic of explosion proof while cutting down on expences and weight.

BACKGROUND OF THE INVENTION

FIG. 1 shows a schematic diagram illustrating the structure of a general color cathode ray tube. As shown in FIG. 1, the color cathode ray tube generally includes a glass envelope having a shape of bulb and being comprised of a faceplate panel 2 to which explosion prevention means is fixed, a tubular neck, and a funnel 3 connecting the panel 2 and the neck. A phosphor screen 7 is formed on the inner surface of the faceplate panel 2. The phosphor screen 7 is coated by phosphor materials of R, G, and B.

A multi-apertured color selection electrode, i.e., shadow mask 8 is mounted to the panel 2. The shadow mask 8 is hold by a peripheral frame 9. An electron gun 6 is mounted within the neck to generate and direct electron beams 5 along paths through the mask to the panel 2.

The cathode ray tube further comprises an inner shield 12 for shielding the tube from external geomagnetism. The inner shield 12 is joined to the frame 9. Further, a spring 10 for combining the frame 9 and the funnel 3 is joined to the frame 9.

The operation of the general cathode ray tube will be described shortly referring to FIG. 1.

The electron beams 5, which are radiated from the electron gun 6 by the voltage applied to the cathode ray tube, impinge upon the phosphor screen 7. The electron beams 5 are deflected in either vertical and horizontal directions by the deflection yokes 13. Furthermore, trajectory of the electron beams 5 are corrected by magnet to impinge upon a desired location on the phosphor screen 7. With the magnet, color purity is improved.

Recently, a color cathode ray tube is getting larger in size and becomes to have wide angle. As color cathode ray tube is getting larger in size, the explosion of the panel or the funnel by external shock increases accordingly. Therefore, the structure of a color cathode ray tube becomes important.

In this regard, a reinforcing band 15 is attached to the sidewall portion of the panel 2 to reinforce strength of the panel or the funnel. Also, corners of the panel 2 are designed to have a predetermined curvature to prevent the cathode ray tube from being exploded by external shock.

Accordingly, In the conventional color cathode ray tube, the weight and cost of the panel account for 50 percent of overall weight and cost of the color cathode ray tube.

For example, in the conventional color cathode ray tube having an effective diagonal diameter of 68 cm and a vertical and horizontal ratio of 16:9 for an effective screen, the weight and cost of the panel account for 40 and 60 percent of overall weight and cost of the color cathode ray tube, respectively.

SUMMARY OF THE INVENTION

An object of the present invention is to provide a color cathode ray tube having a panel structure which provide characteristic of explosion proof while cutting down on expences and weight.

A cathode ray tube according to an embodiment 1 of the present invention comprising: a panel having an effective screen; a funnel connected to the panel; and an electron gun to generate electron beams; wherein said effective screen has a horizontal and vertical ratio of 16:9; and said panel satisfies a condition: $[(\Delta y/d)\times 100]\leqq 5.65$, wherein d is length from a central point G to a diagonal vertex E of said effective screen, and $\Delta y$ is length from a point H to an intersection point of the outline of the panel and the shorter axis Y, the point H being intersection of shorter axis Y and a longer side of said effective screen.

A cathode ray tube according to embodiment 2 of the present invention comprising: a panel having an effective screen; a funnel connected to the panel; and an electron gun to generate electron beams; wherein said effective screen has a horizontal and vertical ratio of of 4:3; and said panel satisfies a condition: $[(\Delta y/d)\times 100]\leqq 5.05$, wherein d is length from a central point G to a diagonal vertex E of said effective screen, and $\Delta y$ is length from a point H to an intersection point of the outline of the panel and the shorter axis Y, the point H being intersection of shorter axis Y and a longer side of said effective screen.

DETAILED DESCRIPTION OF THE INVENTION

Figure 1:
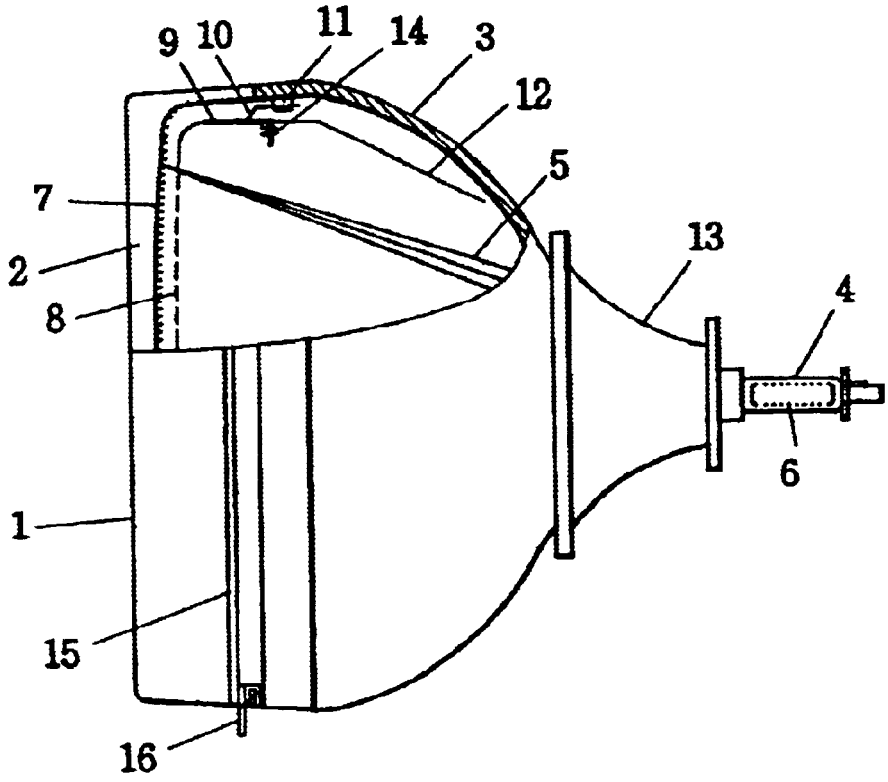
FIG. 1 shows a schematic diagram illustrating the structure of a general color cathode ray tube.
Figure 2:
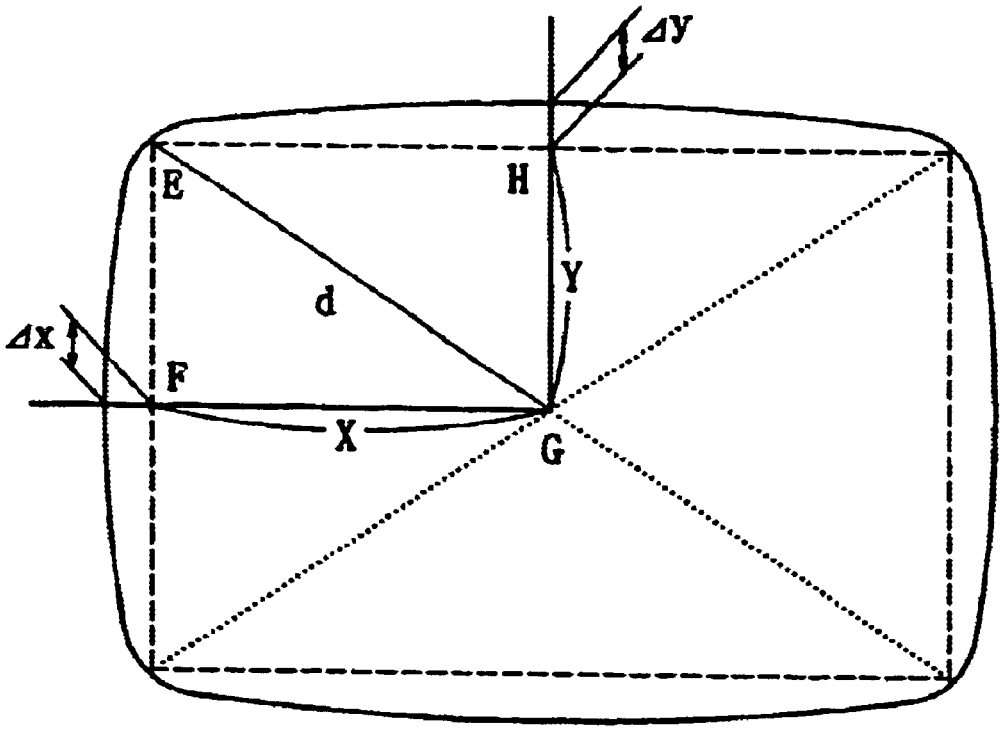
FIG. 2 shows a plane view illustrating longer axis, shorter axis and outermost distances of opposite angle of panel in accordance with the present invention.

FIG. 2 shows a schematic plane view of a panel viewing from the front side for illustrating parameters of an embodiment of the present invention. In FIG. 2, a solid rectangular curve represents outline of the panel and a dotted rectangular represents effective screen of the panel. Hereinafter, the following parameters are used to describe an embodiment of the present invention.

d is length from a central point G to a diagonal vertex E of an effective screen of the panel.

$\Delta x$ is length from a point F to an intersection of the outline of the panel and the longer axis X, wherein the point F is intersection of longer axis X and a shorter side of the effective screen of the panel.

X is length from the central point G of the effective screen to the point F.

$\Delta y$ is length from a point H to an intersection of the outline of the panel and the shorter axis Y, wherein the point H is intersection of shorter axis Y and a longer side of the effective screen of the panel.

Y is length from the central point G of the effective screen to the point H.

<Embodiment 1>

According to Embodiment 1 of the present invention, the effective screen has a horizontal and vertical ratio of 16:9 and satisfies Equation 1.

$$[(\Delta y/d)\times 100]\leqq 5.65 \quad \text{Equation. 1}$$

Preferably, the panel of the cathode ray tube according to Embodiment 1 of the present invention satisfies Equation 2 in addition to Equation 1.

$$[(\Delta y/Y)\times 100]\leqq 11.50 \quad \text{Equation. 2}$$

More preferably, the panel of the cathode ray tube according to Embodiment 1 of the present invention satisfies Equations 3 and 4 in addition to Equations 1 and 2.

$$[(\Delta x/d)\times 100]\leqq 2.05 \quad \text{Equation. 3}$$

$$[(\Delta x/X)\times 100]\leqq 2.35 \quad \text{Equation. 4}$$

Further, Embodiment 1 described hereinabove may be applied to a flat type color cathode ray tube where outer surface of panel is substantially flat. Therefore, the effect of the present invention is still effective for the flat type color cathode ray tube.

Further, Embodiment 2 described hereinabove may be applied to a flat type color cathode ray tube where outer surface of panel is substantially flat. Therefore, the effect of the present invention is still effective for the flat type color cathode ray tube.

Figure 3:
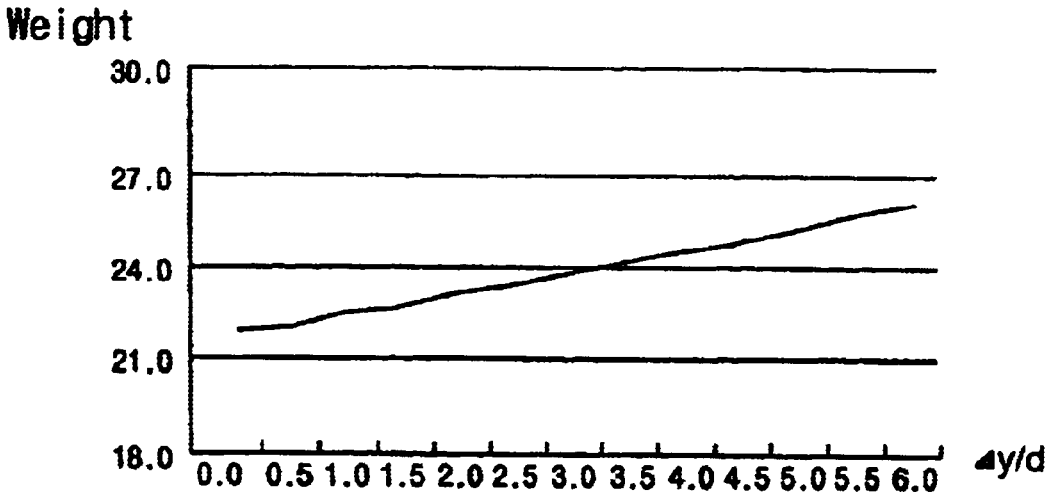
FIG. 3 shows a graph for illustrating the variation of the weight accordance with the shape of panel of the present invention.
Figure 3:
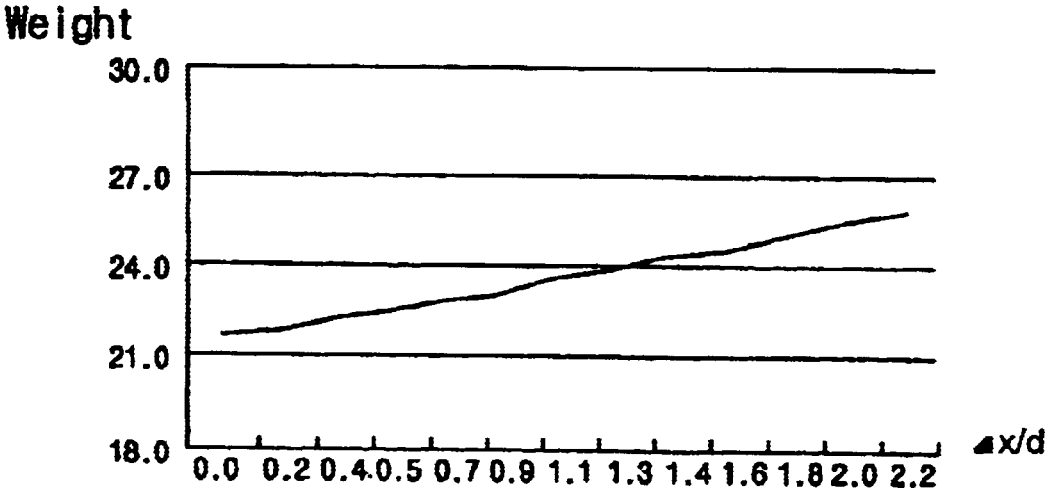

FIG. 3 shows a graph for illustrating variation of the weight of the panel according to the present invention.

In FIG. 3, variation of the weight of the panel is shown with respect to Δx/d, and Δy/d. As shown in FIG. 3, when Δx and Δy decrease with respect to d, the weight of the panel is reduced accordingly.

Table 1 shows the weight and cost of the panel with respect to the weight and cost of overall cathode ray tube according to the prior art and the present invention, for a panel having effective sreen of horizontal and vertical ratio of 16:9.

TABLE 1

| note | Conventional example. 1 | Conventional example. 2 | Boundary data | Embodiment 1-1 | Embodiment 1-2 |
|---|---|---|---|---|---|
| (Δx/d) × 100 (Δy/d) × 100 | 2.45 6.05 | 2.25 5.85 | 2.05 5.65 | 1.85 5.45 | 1.65 5.25 |
| (Δx/X) × 100 (Δy/Y) × 100 | 2.75 12.3 | 2.55 11.9 | 2.35 11.5 | 2.15 11.1 | 1.95 10.7 |
| Weight(kg) | 26.7 | 26.1 | 25.5 | 25.0 | 24.6 |
| Material costs(%) | 102.1 | 10.1 | 100 | 99.1 | 98.2 |

Table 2 shows the weight and cost of the panel with respect to the weight and cost of overall cathode ray tube according to the prior art and the present invention, for a panel having effective sreen of horizontal and vertical ratio of 4:3.

TABLE 2

| note | Conventional example. 1 | Conventional example. 2 | Boundary data | Embodiment 2-1 | Embodiment 2-2 |
|---|---|---|---|---|---|
| (Δx/d) × 100 (Δy/d) × 100 | 3.35 5.45 | 3.15 5.25 | 2.95 5.05 | 2.75 4.85 | 2.55 4.65 |
| (Δx/X) × 100 (Δy/Y) × 100 | 3.90 13.0 | 3.70 11.0 | 3.50 9.00 | 3.30 7.00 | 3.10 5.00 |
| Weight(kg) | 39.0 | 38.3 | 37.5 | 36.8 | 36.2 |
| Material costs(%) | 102.5 | 101.3 | 100 | 99.0 | 98.2 |

<Embodiment 2>

According to Embodiment 2 of the present invention, the effective screen has a horizontal and vertical ratio of 4:3 and satisfies Equation 5.

$$[(\Delta y/d)\times 100]\leqq 5.05 \quad \text{Equation. 5}$$

Preferably, the panel of the cathode ray tube according to Embodiment 2 of the present invention satisfies Equation 6 in addition to Equation 5.

$$[(\Delta y/Y)\times 100]\leqq 9.0 \quad \text{Equation. 6}$$

More preferably, the panel of the cathode ray tube according to Embodiment 2 of the present invention satisfies Equations 7 and 8 in addition to Equations 5 and 6.

$$[(\Delta x/d)\times 100]\leqq 2.95 \quad \text{Equation. 7}$$

$$[(\Delta x/X)\times 100]\leqq 3.5 \quad \text{Equation. 8}$$

As shown in Tables 1 and 2, as the ratios Δx/d, Δy/d, Δx/X and Δy/Y decrease, the weight and cost of the panel in the weight and cost of the overall cathode ray tube are reduced.

Therefore, if the ratios Δx/d, Δy/d, Δx/X and Δy/Y increase, the weight and cost of the panel are increased, which means overall weight and cost of the cathode ray tube is increased too.

On the other hand, if the ratios decrease more than the ratios according to the embodiments of the present invention, the panel and funnel may be exploded by external shock.

INDUSTRIAL APPLICABILITY

According to the present invention, the panel of a color cathode ray tube have the optimum outer structure which provide characteristic of explosion proof while cutting down on expences and weight.

What is claimed is:

1. A cathode ray tube comprising:

a panel having an effective screen;

a funnel connected to the panel; and an electron gun to generate electron beams; wherein said effective screen has a horizontal and vertical ratio of 16:9; and said panel satisfies a condition:

$$[(\Delta y/d)\times 100]\leqq 5.65$$

wherein d is length from a central point G to a diagonal vertex E of said effective screen, and Δy is length from a point H to an intersection point of the outline of the panel and the shorter axis Y, the point H being intersection of shorter axis Y and a longer side of said effective screen.

2. The cathode ray tube of claim 1, wherein said panel further satisties a condition:

$$[(y/Y)\times 100]\leqq 11.50$$

wherein Y is length from the central point G of said effective screen to the point H.

3. The cathode ray tube of claim 1, wherein said panel further satisties a condition:

$$[(\Delta x/d)\times 100]\leqq 2.05$$

wherein Δx is length from a point F to an intersection point of the outline of the panel and the longer axis X, wherein the point F is intersection of longer axis X and a shorter side of said effective screen.

4. The cathode ray tube of claim 3, wherein said panel further satisties a condition:

$$[(\Delta x/X)\times 100]\leqq 3.5$$

wherein X is length from the central point G of said effective screen to the point F.

5. The cathode ray tube of claim 4, wherein said panel further satisties a condition:

$$[(\Delta y/Y)\times 100]\leqq 11.50.$$

6. The cathode ray tube of claim 1, wherein outer surface of said panel is substantially flat.

7. A cathode ray tube comprising:

a panel having an effective screen;

a funnel connected to the panel; and an electron gun to generate electron beams; wherein said effective screen has a horizontal and vertical ratio of of 4:3; and said panel satisfies a condition:

$$[(\Delta y/d)\times 100]\leqq 5.05$$

wherein d is length from a central point G to a diagonal vertex E of said effective screen, and Δy is length from a point H to an intersection point of the outline of the panel and the shorter axis Y, the point H being intersection of shorter axis Y and a longer side of said effective screen.

8. The cathode ray tube of claim 7, wherein said panel further satisties a condition:

$$[(\Delta y/Y)\times 100]\leqq 9.0$$

wherein Y is length from the central point G of said effective screen to the point H.

9. The cathode ray tube of claim 7, wherein said panel further satisties a condition:

$$[(\Delta x/d)\times 100]\leqq 2.95$$

wherein Δx is length from a point F to an intersection point of the outline of the panel and the longer axis X, wherein the point F is intersection of longer axis X and a shorter side of said effective screen.

10. The cathode ray tube of claim 9, wherein said panel further satisties a condition:

$$[(\Delta x/X)\times 100]\leqq 3.5$$

wherein X is length from the central point G of said effective screen to the point F.

11. The cathode ray tube of claim 10, wherein said panel further satisties a condition:

$$[(\Delta y/Y)\times 100]\leqq 9.0$$

12. The cathode ray tube of claim 7, wherein outer surface of said panel is substantially flat.

* * * * *